US010724517B2

(12) United States Patent
Laatiaoui et al.

(10) Patent No.: US 10,724,517 B2
(45) Date of Patent: Jul. 28, 2020

(54) PROPORTIONAL METERING PUMP, METHOD FOR ASSEMBLING AND DISASSEMBLING SUCH A PUMP

(71) Applicant: DOSATRON INTERNATIONAL, Tresses (FR)

(72) Inventors: Najib Laatiaoui, Begles (FR); Christophe Charriere, Camblanes et Meynac (FR)

(73) Assignee: DOSATRON INTERNATIONAL, Tresses (FR)

( * ) Notice: Subject to any disclaimer, the term of this patent is extended or adjusted under 35 U.S.C. 154(b) by 102 days.

(21) Appl. No.: 16/091,617

(22) PCT Filed: Apr. 6, 2017

(86) PCT No.: PCT/EP2017/058249
§ 371 (c)(1),
(2) Date: Oct. 5, 2018

(87) PCT Pub. No.: WO2017/174719
PCT Pub. Date: Oct. 12, 2017

(65) Prior Publication Data

US 2019/0120226 A1 Apr. 25, 2019

(30) Foreign Application Priority Data

Apr. 7, 2016 (FR) ..... 16 53055

(51) Int. Cl.
*F04B 53/22* (2006.01)
*F04B 9/107* (2006.01)
*F04B 13/02* (2006.01)

(52) U.S. Cl.
CPC ..... *F04B 53/22* (2013.01); *F04B 9/107* (2013.01); *F04B 13/02* (2013.01)

(58) Field of Classification Search
CPC ..... F04B 9/107; F04B 13/02; F04B 53/22
See application file for complete search history.

(56) References Cited

U.S. PATENT DOCUMENTS 6,183,212 B1 * 2/2001 Djordjevic ..... F04B 1/0408 123/447
7,975,597 B2 * 7/2011 Darbois ..... F03C 1/26 91/224

(Continued)

FOREIGN PATENT DOCUMENTS

DE 10 2009 054938 A1 6/2011
EP 1 971 774 A1 9/2008

(Continued)

OTHER PUBLICATIONS

International Search Report, dated Jul. 19, 2017, from corresponding PCT application No. PCT/EP2017/058249.

*Primary Examiner* — Patrick Hamo
(74) *Attorney, Agent, or Firm* — Young & Thompson

(57) ABSTRACT

A proportional metering pump includes a hydraulic machine, a metering mechanism provided with a nozzle, and a unit for attaching the nozzle to the pipe for access to the cavity inside the hydraulic machine, including a securing ring mounted in rotation about one of the ends of the nozzle, a locking ring mounted so as to be able to translate along the longitudinal axis around the pipe for access to the mixing chamber and is pressed, in the direction of the metering mechanism, against a shoulder created on the access pipe by a spring, the securing ring and the pipe being able to engage following a screw connection at the end of which they are secured in rotation so as to prevent unscrewing of the securing ring. Also disclosed is a method for assembling and disassembling a metering mechanism on a hydraulic machine of such a pump.

20 Claims, 4 Drawing Sheets

(56) References Cited

U.S. PATENT DOCUMENTS

Figure 1:
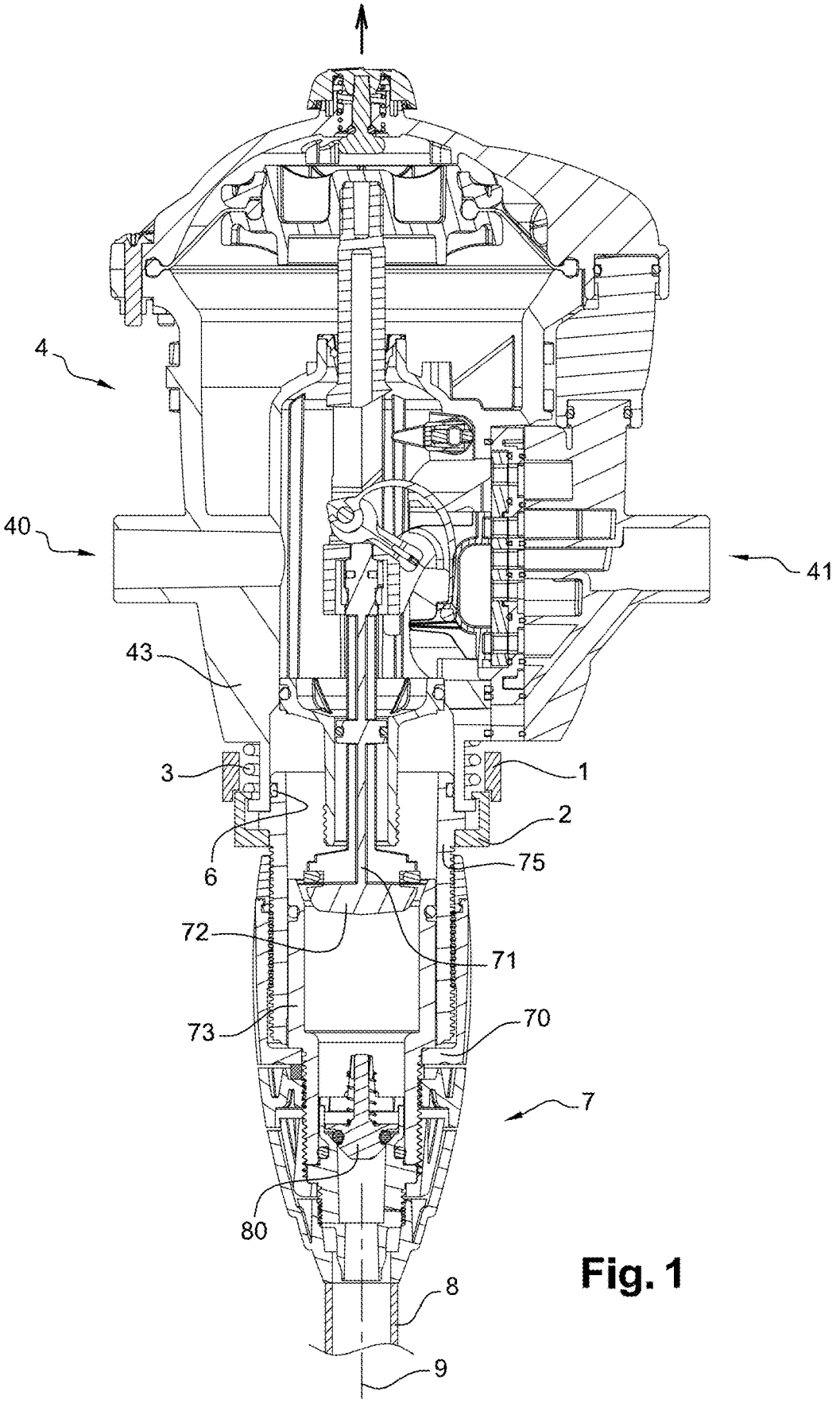

| | | | | |
|---|---|---|---|---|
| 8,132,497 | B2 | 3/2012 | Darbois et al. | |
| 9,303,634 | B2 * | 4/2016 | Furet | F04B 9/105 |
| D864,252 | S * | 10/2019 | Charriere | D15/7 |

FOREIGN PATENT DOCUMENTS

| | | | |
|---|---|---|---|
| EP | 1 971 776 | A1 | 9/2008 |
| EP | 2 199 589 | A2 | 6/2010 |
| FR | 2 681 646 | A1 | 3/1993 |
| FR | 2 967 218 | A1 | 5/2012 |
| WO | 2007/080249 | A1 | 7/2007 |
| WO | 2007/080250 | A1 | 7/2007 |

* cited by examiner

COUPE D-D

COUPE B-B

COUPE C-C

PROPORTIONAL METERING PUMP, METHOD FOR ASSEMBLING AND DISASSEMBLING SUCH A PUMP

The invention relates to a proportional metering pump of the type comprising a hydraulic machine supplied with a main liquid and with a secondary liquid, and a mechanism for metering the secondary liquid. Another object of the invention is a method for mounting and dismantling the metering mechanism with the hydraulic machine.

It is known practice to assemble the metering mechanism with the hydraulic machine by means of a ring mounted free to rotate on an suction nozzle of the metering mechanism. The assembly is done by directly screwing the ring onto a threading formed around the inlet into a cavity internal to the hydraulic machine.

Generally, this internal cavity is a chamber for mixing the main liquid with the secondary liquid upstream of the outlet of the hydraulic machine. This internal cavity is also passed through by a plunger actuated by a member of the hydraulic machine designed to perform a reciprocating movement, said movement being communicated to the plunger and resulting in the suction of the secondary liquid through the metering mechanism, into the internal cavity, if the latter serves as mixing chamber.

However, this type of assembly can however be subject to handling errors or even to unintentional unscrewing. This type of fault then presents a drawback for the user, which is reflected by a loss of the main liquid (generally water). This type of fault also presents a not-inconsiderable risk of leakage of the secondary liquid when the unscrewing is partial, which can lead to a pollution of the site accommodating the pump (the secondary liquid generally being a chemical product such as fertilizer for plantations or even a medication for animals).

This is why the object of the invention is to wholly or partly mitigate the drawbacks stated previously by proposing a proportional metering pump comprising a metering mechanism and a hydraulic machine, and a mounting and dismantling method, making it possible to prevent the involuntary separation between the suction nozzle of the metering mechanism and the hydraulic machine.

More particularly, the subject of the invention is a proportional metering pump comprising a hydraulic machine provided with an inlet and an outlet, a metering mechanism provided with a suction suction nozzle provided with a suction check valve and communicating at one of its ends with an access nozzle to a cavity internal to the pump and, at the other of its ends, with a tank of product to be metered, the hydraulic machine extending along a longitudinal axis and enclosing a member designed to perform a reciprocating movement, the supplying of the pump with liquid at the inlet triggering the reciprocating movement of said member, said movement alternately provoking a suction through the suction nozzle into the internal cavity with opening of the suction check valve when the member moves away from the suction nozzle then an expulsion at the outlet of the pump with closure of the suction check valve when the member approaches the suction nozzle, characterized in that the pump further comprises means for fixing the suction nozzle to the access nozzle to the cavity internal to the hydraulic machine, said means comprising:

- a fixing ring provided with a first end and a second end and mounted to rotate about one of the ends of the suction nozzle,
- a blocking ring provided with a first end and a second end, and mounted to translate along the axis of the hydraulic machine along the access nozzle to the mixing chamber, the first end of said ring being pressed toward the metering mechanism against a shoulder formed on said access nozzle by means of a spring, the fixing ring and the access nozzle to the cavity internal to the hydraulic machine being capable of cooperating by screwing, at the end of which the second end of the blocking ring is secured in rotation by complementarity of form with the second end of the fixing ring, so as to lock the unscrewing of the fixing ring.

Optional features of the invention, complementary or substitute, are stated hereinbelow.

The screwing is preferably less than a half-turn.

The fixing ring can comprise, at its second end and at its inner circumferential surface, a multi-start male threading consisting of two to eight threads extending along one and the same helix, the access nozzle to the cavity internal to the hydraulic machine being provided with a complementary female threading.

In the case of a multi-start male threading, the latter can consist of four threads extending over a length corresponding to a screwing by an eighth of a turn.

The access nozzle to the cavity internal to the hydraulic machine can comprise a multi-start male threading consisting of two to eight threads extending along one and the same helix, the fixing ring being provided, at its second end and at its inner circumferential surface, with a complementary female threading.

The multi-start male threading of the nozzle can then consist of four threads extending over a length corresponding to a screwing by an eighth of a turn.

The access nozzle to the cavity internal to the hydraulic machine and the fixing ring can cooperate by screwing by a configuration of bayonet type, one of the access nozzle to the internal cavity and the fixing ring being provided with at least one lug capable of being blocked in a groove formed on the other of the access nozzle to the internal cavity and the fixing ring.

The second end of the blocking ring comprises locking tabs capable of occupying the space between portions of increasing height formed on the second end of the fixing ring, said threads being borne by said portions.

The constituent elements of the pump are manufactured by injection of thermoplastic plastic materials chosen from the list defined by polyamides, polyvinylidene fluorides, high density polyethylenes, filled or unfilled polypropylene, polyformaldehydes.

Sealing means can be interposed between the suction nozzle and the access nozzle to the mixing chamber.

Another subject of the invention is a first method for mounting a proportional metering pump according to any one of the embodiments of the invention, characterized in that the fixing ring with the access nozzle to the cavity internal to the hydraulic machine is screwed until the second end of the blocking ring is secured in rotation with the second end of the fixing ring by complementarity of form, so as to lock the unscrewing of the fixing ring.

According to a preferential feature, the screwing is less than a half-turn.

Another subject of the invention is a first method for dismantling a proportional metering pump according to any one of the embodiments of the invention, characterized in that the blocking ring is translated so as to separate the first end of said ring from the shoulder against which it was bearing, then the fixing ring is unscrewed from the access nozzle to the cavity internal to the hydraulic machine.

According to a preferential feature, the unscrewing is less than a half-turn.

Figure 2:
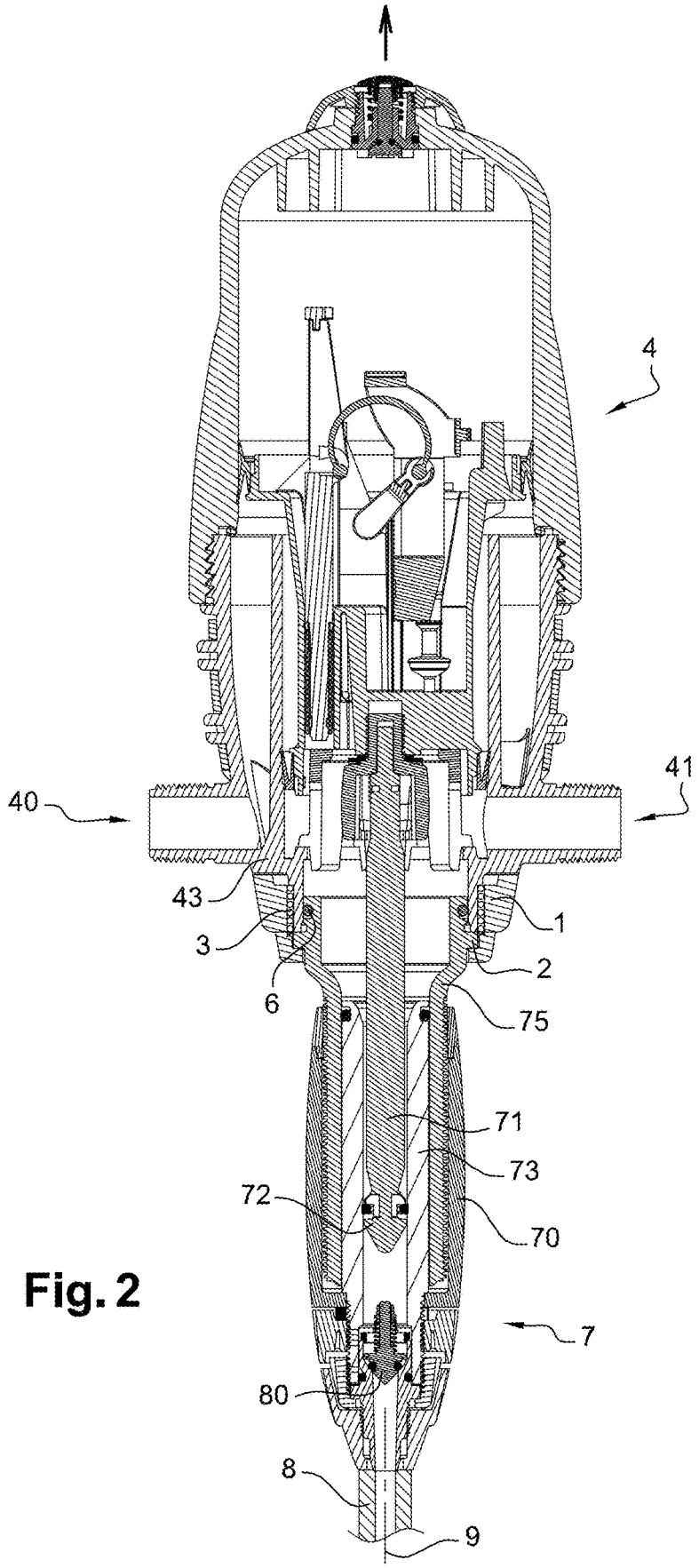
Figure 3:
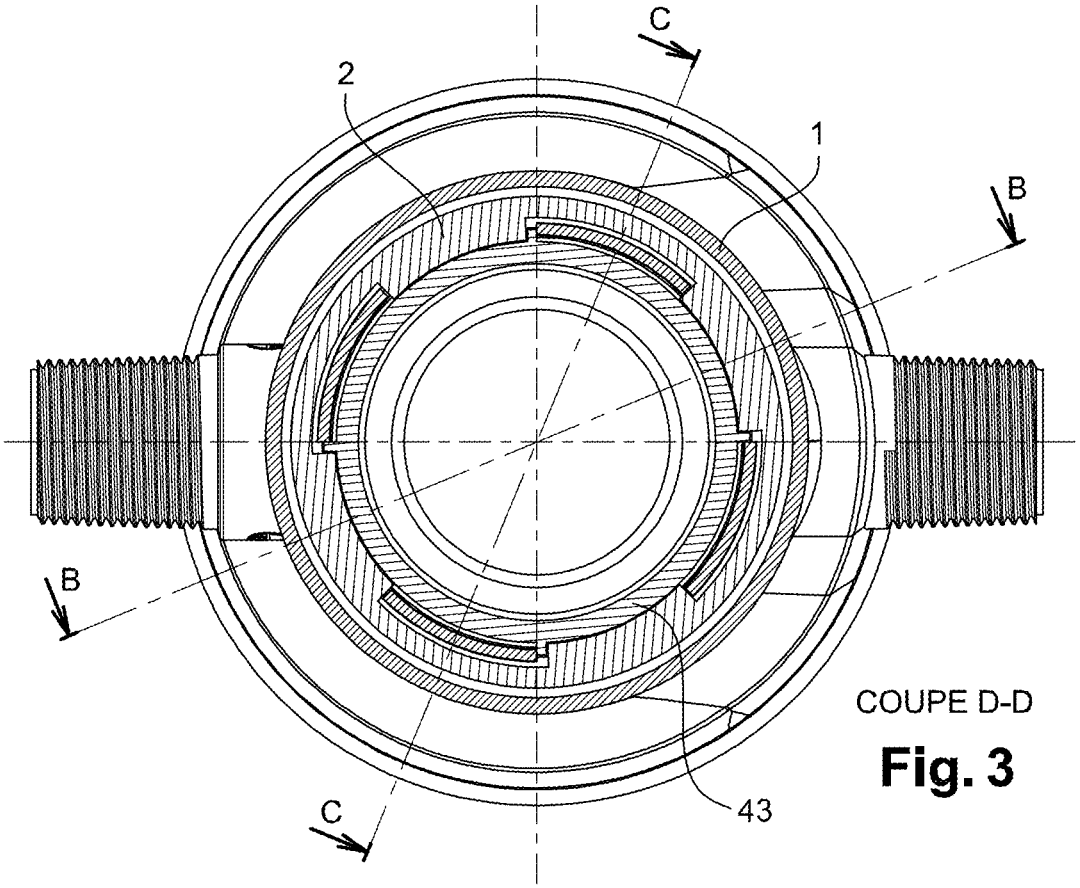
Figure 4:
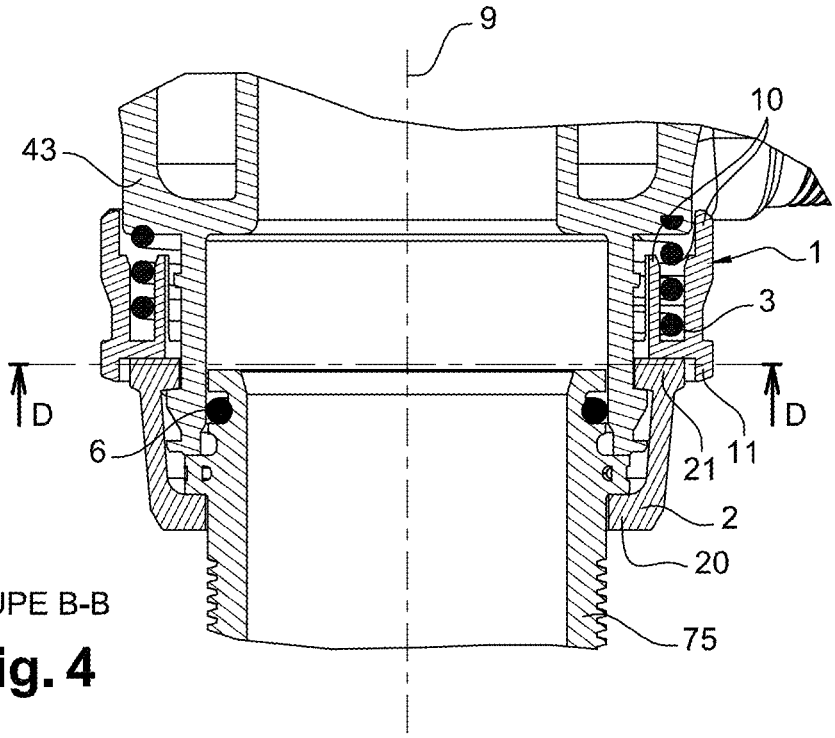
Figure 5:
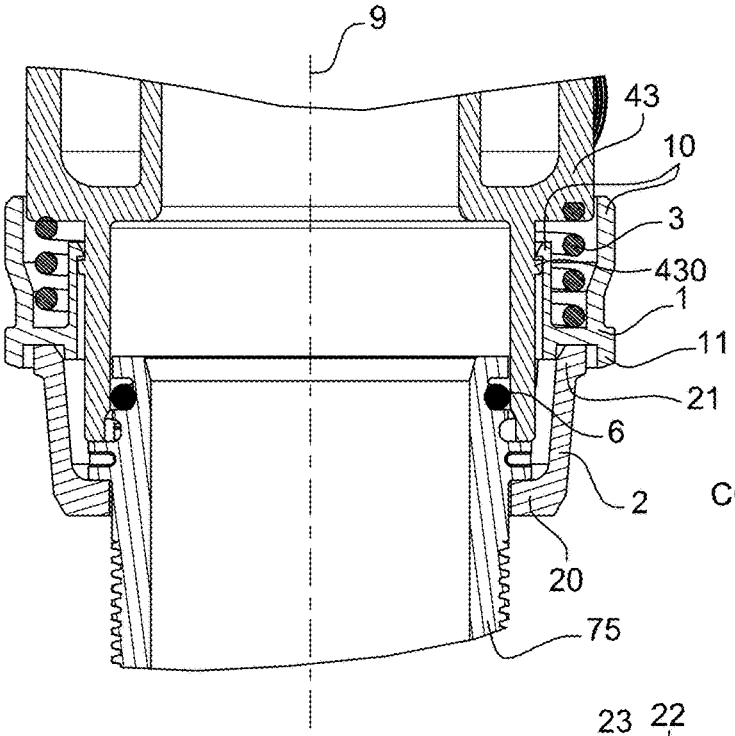
Figure 6:
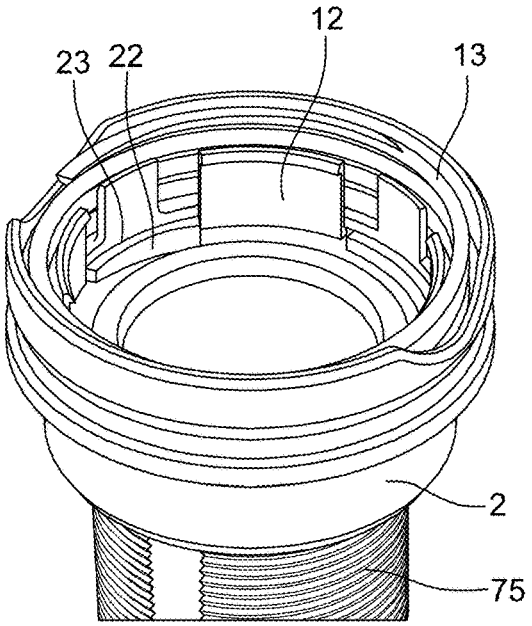
Figure 7:
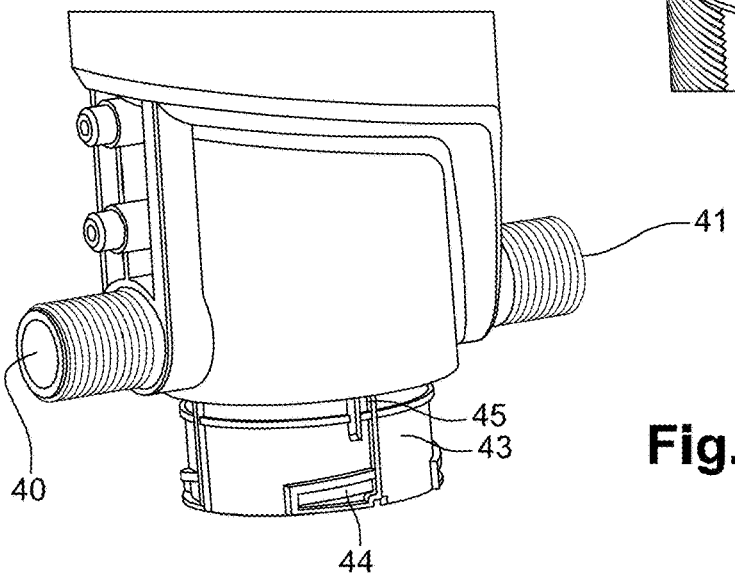

Other advantages and particular features of the invention will become apparent on reading the detailed description of unlimited implementations and embodiments, and the following attached figures:

FIG. 1 is a schematic representation of a proportional metering pump using a first type of hydraulic machine and conforming to an embodiment of the invention, FIG. 2 is a schematic representation of a proportional metering pump using a second type of hydraulic machine and conforming to an embodiment of the invention, FIG. 3 is a representation of a detailed view of the invention according to a cross-section on a plane at right angles to the axis of the pump, FIGS. 4 and 5 are representations of a detailed view of the invention on cross sections along the longitudinal axis of the pump, FIGS. 6 and 7 are perspective views of the invention.

Since the embodiments described herein below are unlimited, it will in particular be possible to consider variants of the invention comprising only a selection of features described, isolated from the other features described (even if this selection is isolated within a sentence comprising these other features), if this selection of features is sufficient to confer a technical advantage or to differentiate the invention from the state of the prior art. This selection comprises at least one feature, preferably functional without structural details, or with only a part of the structural details if this part alone is sufficient to confer a technical advantage or to differentiate the invention from the state of the prior art.

For conciseness and clarity, the elements bear the same references on the different figures.

FIGS. 1 and 2 each represent an embodiment of a proportional metering pump. It comprises a hydraulic machine 4 extending along a longitudinal axis 9, and provided with an inlet 40, an outlet 41, an access nozzle to an internal cavity 43, and a suction suction nozzle 75. This suction suction nozzle is provided with a suction check valve 80 communicating at one of its ends with a cavity internal to the pump (not represented in the figure) and at the other of its ends with a container of product to be sucked (not represented in the figure).

The hydraulic machine is provided with a member designed to perform a reciprocating movement, the supplying of the pump with liquid at the inlet triggering the reciprocating movement of the member, said movement alternately provoking a suction through the suction nozzle into the internal cavity with opening of the suction check valve 80 when the member moves away from the suction nozzle 75 then an expulsion at the outlet 41 of the pump with closure of the first suction check valve when the member approaches the suction nozzle.

The hydraulic machine can be of the type of that described in the document EP1971776 A1 and in FIG. 1.

This hydraulic machine comprises an enclosure comprising a body and a cover, a separation means designed to perform a reciprocating movement in the enclosure between the body and the cover, this separation means defining two chambers. The hydraulic machine also comprises hydraulic switching means for the supplying of liquid to and the discharging from the abovementioned chambers. These communication means comprise a dispensing member that can take two stable positions and controlled by the movements of the separation means. The body of the enclosure also encloses a compartment linked to a pressurized liquid intake and in which are housed the switching means, and triggering means comprising a thruster linked to the separation means, designed to provoke, at the end of travel, an abrupt change of the position of the switching means, under the action of an elastic means for reversing the travel. The dispensing member comprises a dispensing slide valve pressed against a planar plate that is fixed relative to the body of the enclosure, the dispensing slide valve being able to slide in a seal-tight manner, without seal, against the plate which comprises orifices linked respectively to the chambers of the enclosure and to a liquid outlet orifice. The slide valve is then designed to, depending on its position, close some of the orifices or connect them with the fluid intake or with the exhaust.

The hydraulic machine can also be of the type of that described in the document EP1971774 A1 and in FIG. 2.

In this case, the hydraulic machine comprises an enclosure, a piston designed to slide by reciprocating movement in the enclosure, the piston dividing the enclosure into two chambers, hydraulic switching means for the supply of liquid to and the discharging from the chambers separated by the piston. These switching means are controlled by the movements of the piston and comprise at least one connecting rod acting on a dispensing member that can take two stable positions. Triggering means are also provided comprising a thruster designed to provoke, at the end of the travel of the piston, an abrupt change of the position of the switching means, under the action of an elastic means, for reversing the travel. The elastic means is secured, at one of its ends, to an articulation member received respectively in a housing provided on the connecting rod and on another moving part of the hydraulic machine, each housing being open in a direction substantially opposite to the direction of the force exerted by the elastic means in the housing, such that each articulation member can be extracted from its open housing against said force.

The proportional metering pump also comprises a metering mechanism 7 for adjusting the volume sucked into the suction nozzle 75. This mechanism is described in FIGS. 1 and 2 and involves an suction nozzle nut 70 which drives the body of the measurer 73 into its sleeve 70. Since, at the top dead point of the hydraulic machine, the plunger 71 and the metering seal 72 leave the body of the measurer 73, the metering travel is therefore more or less long. Because of this, the sucked volume is more or less great. Since the volume of water for a cycle is quasi-constant, the metering is therefore more or less great.

As represented in more detail in FIGS. 3, 4, 5, 6 and 7, the pump also comprises means for fixing the suction nozzle 75 to the access nozzle 43 to the internal cavity of the hydraulic machine.

These means comprise a fixing ring 2 of substantially annular form, extending between a first end 20 and a second end 21. This fixing ring is mounted free to rotate about the end of the suction nozzle 75 intended to be secured with the nozzle 43 of the hydraulic machine 4. This ring can for example be mounted on the suction nozzle 75, subject to a reduced internal diameter at its end 20 such that said end comes to abut against a shoulder formed on the end of the suction nozzle 75. In this way, the suction nozzle cannot be disengaged from the fixing ring 2 when the suction nozzle is fixed to the access nozzle to the internal cavity.

These means also comprise a blocking ring 1 also of substantially annular form, extending between a first end 10 and a second end 11. This fixing ring is to be fixed in rotation relative to the hydraulic machine and free to translate along the access nozzle to the mixing chamber. This mounting can be performed through ribs and complementary grooves formed respectively on the surface of the nozzle and on the inner circumferential surface of the blocking ring. According to one embodiment, it is therefore possible to provide at least one groove 45 on the outer circumferential surface of the nozzle 43, capable of accommodating a runner provided on the inner circumferential surface of the blocking ring 1.

Spring-forming means 3 keep, by their return force, the first end 10 of said ring pressed against a shoulder 430 formed on said nozzle and toward the metering mechanism 7 and the suction nozzle 75.

"Spring" should be understood to mean any mechanical device designed to store energy when it is deformed and to restore the same quantity when it is released. The means 3 can, by way of example, be a spring of the type with metal turns or with thermoplastic blade.

The fixing ring and the access nozzle to the cavity internal to the hydraulic machine are capable of cooperating by screwing. Screwing should be understood to mean a displacement in a Euclidean affine space which is the commutative compound of a rotation and of a translation by a vector directing the axis of rotation (in this case the axis 9). Thus, the assembly of the fixing ring and of the nozzle should be understood in the broad sense and should not be limited to the simple cooperation of threading between two parts.

Preferably, the screwing is less than a half-turn such that the coupling between the fixing ring and the hydraulic machine is performed rapidly.

At the end of the screwing, the second end 11 of the blocking ring is secured with the second end 21 of the fixing ring by complementarity of form. In other words, the surfaces of the ends 11 and 21 of the rings are nested so as to prevent the rotation of one relative to the other. In this way, the unscrewing of the fixing ring is locked.

According to a first embodiment, the fixing ring comprises, at its second end 21 and on its inner circumferential surface, a multi-start male threading consisting of two to eight threads extending along one and the same helix. The access nozzle to the cavity internal to the hydraulic machine consequently comprises a complementary female threading 44 machined on its outer circumferential surface.

Preferentially, the multi-start male threading consists of four threads extending over a length corresponding to screwing by an eighth of a turn.

The threading can equally be machined or injection molded.

According to a variant, the access nozzle 43 to the cavity internal to the hydraulic machine comprises, on its outer circumferential surface, a multi-start male threading consisting of two to eight threads extending along one and the same helix. The fixing ring is then provided, for its part, at its second end 21 and on its inner circumferential surface, with a complementary female threading.

Preferentially, the multi-start male threading consists of four threads extending over a length corresponding to screwing by an eighth of a turn.

According to a second embodiment, the access nozzle to the cavity internal to the hydraulic machine and the fixing ring cooperate by screwing by a configuration of bayonet type.

According to a first variant, the access nozzle to the internal cavity is provided, on its outer circumferential surface, with at least one lug capable of being blocked in a groove formed on the inner circumferential surface of the fixing ring.

According to a second variant, it is the fixing ring which is provided on its inner circumferential surface with at least one lug capable of being blocked in a groove formed on the outer circumferential surface of the access nozzle to the mixing chamber.

In the configurations according to which the nozzle and the fixing ring cooperate by threads of the multi-start type, the second end 11 of the blocking ring comprises locking tabs 12 capable of occupying the space between portions 23 formed on the second end 21 of the fixing ring bearing the threads 22.

Advantageously, the portions 23 are of increasing height, such that the locking tabs 12 follow the increasing summit of these portions like a ramp during the screwing operation and push back the blocking ring, until said locking tabs fall into the space between the portions 23 under the action of the return force of the spring, once the end of the screwing is reached.

So as to simplify the manufacturing of the pump, the constituent elements are preferably manufactured by injection of thermoplastic plastic materials chosen from the list defined by polyamides, polyvinylidene fluorides, high density polyethylenes, filled or unfilled polypropylenes, polyformaldehydes.

So as to render the metering mechanism seal-tight, sealing means 6 are interposed between the outer circumferential surface of the suction nozzle 75 and the inner circumferential surface of the access nozzle 43 to the mixing chamber.

Now regarding the method for mounting a proportional metering pump according to one of the embodiments explained hereinabove, the screwing of the fixing ring 2 with the access nozzle to the cavity internal to the hydraulic machine is first of all triggered. At the end of the screwing, the second end 11 of the blocking ring is rendered secure in rotation with the second end 21 of the fixing ring by complementarity of form. As explained previously, it is possible to employ any type of complementarity such as the locking tabs 12 complementing spaces between the threads 22. These complementarities are borne for one by the blocking ring and for the other by the fixing ring. The action of the return force of the spring subjected to a compression upon the screwing, allows one of the complementary forms to overcome the obstacle during the screwing and to be inserted into the corresponding complementary form at the end of the screwing. At the end of the screwing, the unscrewing of the fixing ring is made impossible.

Now regarding the method for dismantling a proportional metering pump according to one of the embodiments explained hereinabove, the blocking ring is translated so as to move the first end of said ring away from the shoulder 430 against which it was bearing. In this way, the complementary forms are disengaged. Then, the fixing ring is unscrewed out of the access nozzle 43.

Obviously, the invention is not limited to the examples which have just been described and many improvements can be added to these examples without departing from the scope of the invention. Furthermore, the various features, forms, variants and embodiments of the invention can be associated with one another according to various combinations in so far as they are not mutually incompatible or exclusive.

The invention claimed is:

1. A proportional metering pump comprising a hydraulic machine (4) provided with an inlet (40) and an outlet (41), a metering mechanism (7) provided with a suction suction nozzle (75) provided with a suction check valve (80) and communicating at one of its ends with an access nozzle to a cavity internal to the pump and, at the other of its ends, with a tank of product to be metered, the hydraulic machine extending along a longitudinal axis (9) and enclosing a member designed to perform a reciprocating movement, the supplying of the pump with liquid at the inlet triggering the reciprocating movement of the member, said movement alternately provoking a suction through the suction nozzle into the internal cavity with opening of the suction check valve (80) when the member moves away from the suction nozzle (75) then an expulsion at the outlet (41) of the pump with closure of the suction check valve when the member approaches the suction nozzle, wherein the pump further comprises means for fixing the suction nozzle (75) to the access nozzle to the cavity internal to the hydraulic machine (43), said means comprising:

a fixing ring (2) provided with a first end (20) and a second end (21) and mounted to rotate about one of the ends of the suction nozzle (75), a blocking ring (1) provided with a first end (10) and a second end (11), and mounted to translate along the longitudinal axis (9) along the access nozzle to the mixing chamber (43), the first end (10) of said ring being pressed toward the metering mechanism against a shoulder (430) formed on said access nozzle by means of a spring (3), the fixing ring and the access nozzle to the cavity internal to the hydraulic machine being capable of cooperating by screwing, at the end of which the second end (11) of the blocking ring is secured with the second end (21) of the fixing ring by complementarity of form, so as to lock the unscrewing of the fixing ring.

2. The proportional metering pump as claimed in claim 1, wherein the screwing is less than a half-turn.

3. The proportional metering pump as claimed in claim 1, wherein the fixing ring comprises, at its second end (21) and at its inner circumferential surface, a multi-start male threading consisting of two to eight threads (22) extending along one and the same helix, while the access nozzle to the cavity internal to the hydraulic machine is provided with a complementary female threading (44).

4. The proportional metering pump as claimed in claim 3, wherein the multi-start male threading consists of four threads extending over a length corresponding to a screwing by an eighth of a turn.

5. The proportional metering pump as claimed in claim 1, wherein the access nozzle to the cavity internal to the hydraulic machine comprises a multi-start male threading consisting of two to eight threads extending along one and the same helix, the fixing ring being provided, at its second end (21) and at its inner circumferential surface, with a complementary female threading.

6. The proportional metering pump as claimed in claim 5, wherein the multi-start male threading consists of four threads extending over a length corresponding to a screwing by an eighth of a turn.

7. The proportional metering pump as claimed in claim 1, wherein the access nozzle to the cavity internal to the hydraulic machine and the fixing ring cooperate by screwing by a configuration of bayonet type, one of the access nozzle to the internal cavity and the fixing ring being provided with at least one lug capable of being blocked in a groove formed on the other of the access nozzle to the internal cavity and the fixing ring.

8. The proportional metering pump as claimed in claim 3, wherein the second end (11) of the blocking ring comprises locking tabs (12) capable of occupying the space between portions (23) of increasing height formed on the second end (21) of the fixing ring, the threads being borne by said portions.

9. The proportional metering pump as claimed in claim 1, wherein the constituent elements of the pump are manufactured by injection of thermoplastic plastic materials chosen from the list defined by polyamides, polyvinylidene fluorides, high density polyethylenes, filled or unfilled polypropylenes, polyformaldehydes.

10. The proportional metering pump as claimed in claim 1, wherein sealing means (6) are interposed between the suction nozzle (75) and the access nozzle to the mixing chamber (43).

11. A method for mounting a proportional metering pump conforming to claim 1, wherein the fixing ring with the access nozzle to the cavity internal to the hydraulic machine is screwed until the second end of the blocking ring is secured in rotation with the second end of the fixing ring by complementarity of form, so as to lock the unscrewing of the fixing ring.

12. The method for mounting a proportional metering pump as claimed in claim 11, wherein the screwing is less than a half-turn.

13. A method for dismantling a proportional metering pump conforming to claim 1, wherein the blocking ring is translated so as to separate the first end of said ring from the shoulder against which it was bearing, then the fixing ring is unscrewed from the access nozzle to the cavity internal to the hydraulic machine.

14. The method of dismantling a proportional metering pump as claimed in claim 13, wherein the unscrewing is less than a half-turn.

15. The proportional metering pump as claimed in claim 2, wherein the fixing ring comprises, at its second end (21) and at its inner circumferential surface, a multi-start male threading consisting of two to eight threads (22) extending along one and the same helix, while the access nozzle to the cavity internal to the hydraulic machine is provided with a complementary female threading (44).

16. The proportional metering pump as claimed in claim 4, wherein the second end (11) of the blocking ring comprises locking tabs (12) capable of occupying the space between portions (23) of increasing height formed on the second end (21) of the fixing ring, the threads being borne by said portions.

17. The proportional metering pump as claimed in claim 2, wherein the constituent elements of the pump are manufactured by injection of thermoplastic plastic materials chosen from the list defined by polyamides, polyvinylidene fluorides, high density polyethylenes, filled or unfilled polypropylenes, polyformaldehydes.

18. The proportional metering pump as claimed in claim 3, wherein the constituent elements of the pump are manufactured by injection of thermoplastic plastic materials chosen from the list defined by polyamides, polyvinylidene fluorides, high density polyethylenes, filled or unfilled polypropylenes, polyformaldehydes.

19. The proportional metering pump as claimed in claim 4, wherein the constituent elements of the pump are manufactured by injection of thermoplastic plastic materials chosen from the list defined by polyamides, polyvinylidene fluorides, high density polyethylenes, filled or unfilled polypropylenes, polyformaldehydes.

20. The proportional metering pump as claimed in claim 5, wherein the constituent elements of the pump are manufactured by injection of thermoplastic plastic materials chosen from the list defined by polyamides, polyvinylidene fluorides, high density polyethylenes, filled or unfilled polypropylenes, polyformaldehydes.

* * * * *